US007059547B2

(12) United States Patent
Kobayashi et al.

(10) Patent No.: US 7,059,547 B2
(45) Date of Patent: Jun. 13, 2006

(54) FUEL INJECTION VALVE

(75) Inventors: Nobuaki Kobayashi, Gunma (JP); Hideo Kato, Tochigi (JP); Hiroshi Okada, Gunma (JP)

(73) Assignee: Hitachi Ltd., Tokyo-to (JP)

( * ) Notice: Subject to any disclaimer, the term of this patent is extended or adjusted under 35 U.S.C. 154(b) by 122 days.

(21) Appl. No.: 10/190,833

(22) Filed: Jul. 9, 2002

(65) Prior Publication Data

US 2003/0015609 A1 Jan. 23, 2003

(30) Foreign Application Priority Data

Jul. 13, 2001 (JP) ..... 2001-214103

(51) Int. Cl.

| | |
|---|---|
| ***F02M 61/00*** | (2006.01) |
| ***F02M 51/00*** | (2006.01) |
| ***B05B 1/30*** | (2006.01) |
| ***B05B 1/00*** | (2006.01) |
| ***B05B 1/14*** | (2006.01) |

(52) U.S. Cl. ..... 239/533.12; 239/585.1; 239/596; 239/557

(58) Field of Classification Search ..... 239/585.1, 239/585.2, 585.3, 585.4, 585.5, 533.12, 596, 239/557, 556

See application file for complete search history.

(56) References Cited

U.S. PATENT DOCUMENTS

| | | | | |
|---|---|---|---|---|
| 4,699,323 | A * | 10/1987 | Rush et al. | 239/585.4 |
| 5,129,381 | A * | 7/1992 | Nakajima | 239/533.12 |
| 5,540,200 | A * | 7/1996 | Naitoh et al. | 239/533.12 |
| 6,186,418 | B1 * | 2/2001 | Tani | 239/533.12 |
| 6,308,684 | B1 * | 10/2001 | Konishi | 239/533.12 |
| 2002/0053610 | A1 * | 5/2002 | Takagi et al. | 239/584 |
| 2003/0222159 | A1 * | 12/2003 | Kobayashi et al. | 239/533.12 |

FOREIGN PATENT DOCUMENTS

JP 8-303321 11/1996

* cited by examiner

*Primary Examiner*—David A. Scherbel
*Assistant Examiner*—Darren Gorman
(74) *Attorney, Agent, or Firm*—Sughrue Mion, PLLC

(57) ABSTRACT

A fuel injection valve is comprised of a nozzle plate which has at least four nozzle-hole sets. Each of the nozzle-hole sets has at least two nozzle holes through which fuel injection flows are injected and are collided with each other. The nozzle-hole sets are arranged into two aggregations so that the collided fuel injection flows are joined and are directed to two different directions.

9 Claims, 11 Drawing Sheets

FUEL INJECTION VALVE

BACKGROUND OF THE INVENTION

The present invention relates to a fuel injection valve which is preferably employed as a fuel injection valve of an internal combustion engine.

Japanese Patent Provisional Publication No. 8-303321 discloses a fuel injection valve for an internal combustion engine. This fuel injection valve comprises a nozzle plate which has two pairs of nozzle holes for injecting fuel injection flows.

SUMMARY OF THE INVENTION

However, if the two pairs of the nozzle holes are designed to satisfy a requirement in a flow rate of the fuel, it is necessary to set a diameter of each nozzle hole at a relatively large size. Such design of the fuel injection valve restricts the atomization of the injected fuel even if the fuel injection flows injected from each pair of the nozzle holes are collided with each other.

It is an object of the present invention to provide an improved fuel injection valve which is capable of ensuring a sufficient quantity of injected fuel while promoting atomization of the injected fuel.

An aspect of the present invention resides in a fuel injection valve which comprises a casing comprising a fuel passage; a valve seat member disposed in the valve casing, the valve seat member comprising a valve seat; a valve element displaceably disposed in the casing; and a nozzle plate covering the valve seat, the nozzle plate comprising at least four nozzle-hole sets each of which comprises at least two nozzle holes, fuel injection flows being injected from the nozzle holes and being collided with each other when the valve element is released from the valve seat, the nozzle-hole sets constituting two nozzle-hole-set aggregations, the nozzle-hole-set aggregations being arranged to direct the collided fuel injection flows to two different directions.

Another aspect of the present invention resides in a fuel injection valve which comprises a casing comprising a fuel passage; a valve seat member disposed in the casing, the valve seat member comprising a valve seat; a valve element displaceably disposed in the casing; and a nozzle plate covering the valve seat, the nozzle plate comprising two nozzle-hole sets each of which comprises three nozzle holes, fuel injection flows being injected from the nozzle holes of each of the nozzle-hole sets being collided with each other when the valve element is released from the valve seat, the nozzle-hole sets being arranged to direct the collided fuel injection flows to two different directions.

A further another aspect of the present invention resides in a fuel injection valve which comprises a casing defining a fuel passage; a valve seat member disposed in the casing, the valve seat member defining a valve seat; a valve element displaceably disposed in the casing; and a nozzle plate covering the valve seat, the nozzle plate comprising first and second nozzle-hole-set aggregations which are symmetrically arranged with respect to a center line of the nozzle plate, each of the first and second nozzle-hole-set aggregations comprising at least two nozzle-hole sets, each of the nozzle-hole sets comprising at least two nozzle holes, fuel injection flows being injected from the nozzle holes of each of the nozzle-hole sets and being collided with each other when the valve element is displaced so as to form a clearance between the valve element and the valve seat, the fuel injection flows being joined by each of the first and second nozzle-hole-set aggregations and forming a splay pattern directed to a direction which gradually increasing a distance to an axis orthogonal to the center line and a plane including the nozzle holes of the nozzle plate.

The other objects and features of this invention will become understood from the following description with reference to the accompanying drawings.

DETAILED DESCRIPTION OF THE INVENTION

A fuel injection valve according to embodiments of the present invention will be discussed in detail with reference to FIGS. 1 through 13.

A first embodiment according to the present invention will be discussed with reference to FIGS. 1 through 10. In this first embodiment, a fuel injection valve employed in an internal combustion engine of a vehicle is discussed.

Figure 1:
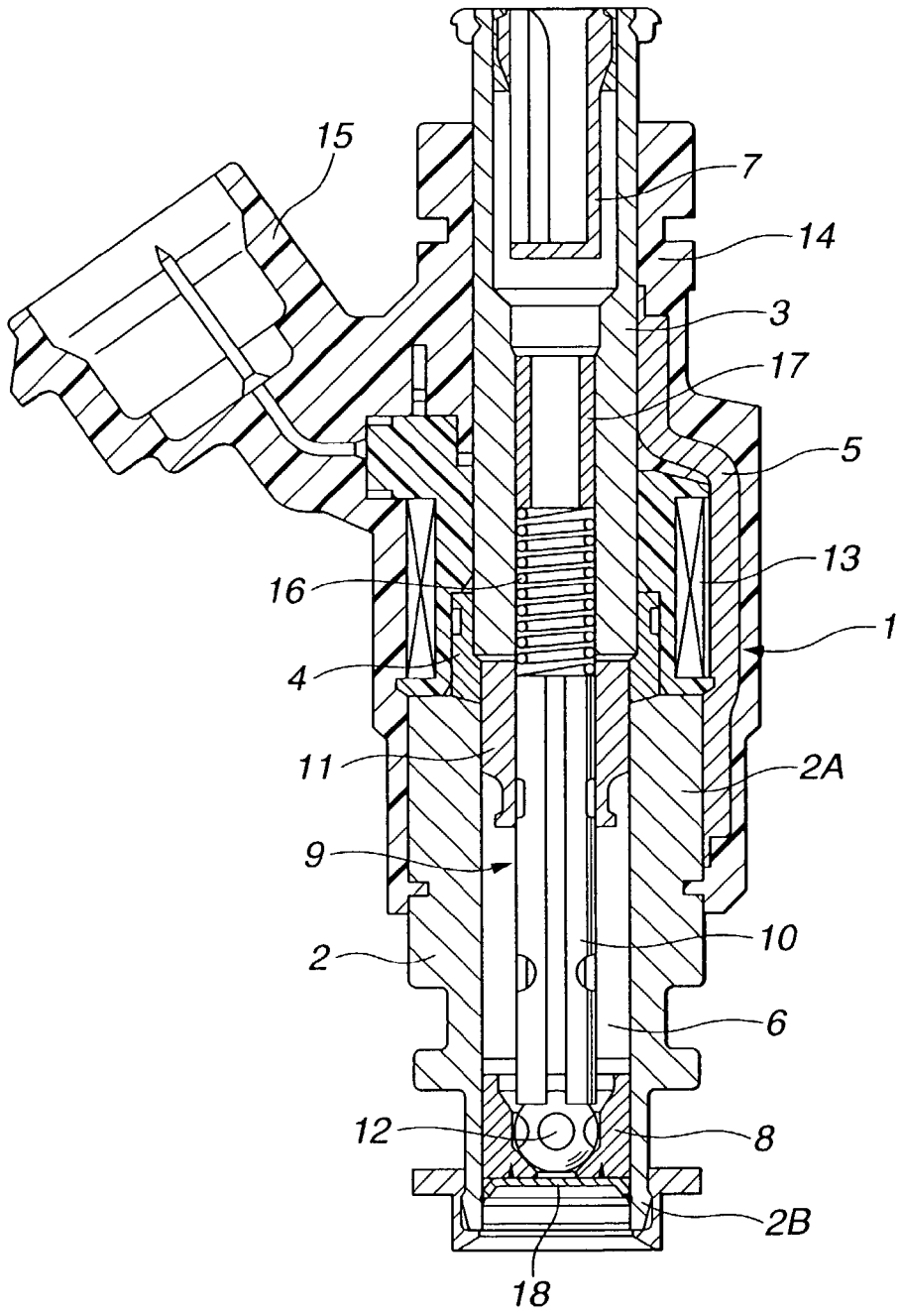
FIG. 1 is a cross sectional view showing a fuel injection valve of a first embodiment according to the present invention.

As shown in FIG. 1, a casing 1 has a form of a cylinder and functions as a main body of the fuel injection valve. Casing 1 comprises a valve casing 2, a fuel inlet pipe 3, and a magnetic-path forming member 5. Valve casing 2 is formed into a stepped cylinder and functions as a tip end portion of casing 1. Valve casing 2 is made of a magnetic material such as ferromagnetic stainless steel and has a large cylindrical portion 2A whose base portion is connected to a plastic cover 14 and a small cylindrical portion 2B which is integral with a tip end portion of large cylinder portion 2A.

Fuel inlet pipe 3 is made of magnetic material such as magnetic stainless steel and has the form of a cylinder. Fuel inlet pipe 3 is disposed at a base end portion of valve casing 2 through a cylindrical connecting member 4, which is made of non-magnetic material. Further, fuel inlet pipe 3 is magnetically interconnected with valve casing 2 through a magnetic-path forming member 5, which is made of magnetic material and is disposed at an outer periphery of an electromagnetic coil 13. Accordingly, when electromagnetic coil 13 is energized, a closed magnetic path is formed by valve casing 2, fuel inlet pipe 3, magnetic-path forming member 5 and an attracting portion 11 of a valve element 9. In casing 1, a fuel passage 6 axially extends from the base end portion of fuel inlet pipe 3 to a position of a valve seat member 8 through valve casing 2, and a fuel filter 7 for filtrating fuel supplied into fuel passage 6 is disposed.

Figure 2:
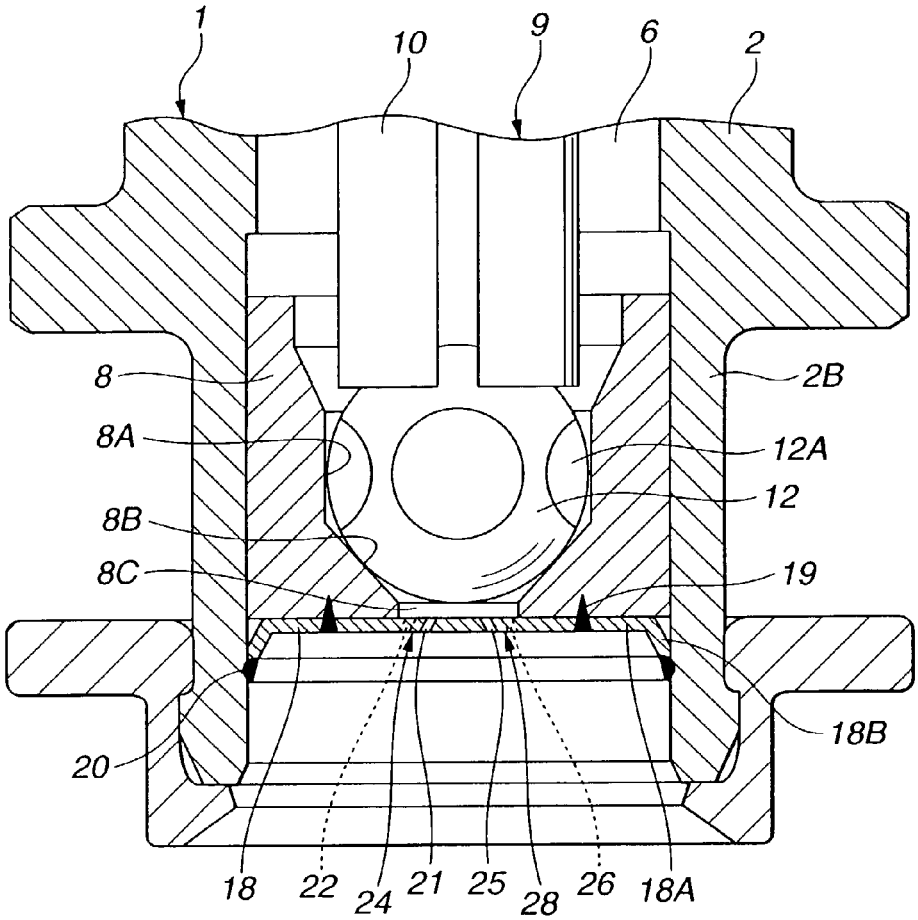
FIG. 2 is an enlarged cross sectional view showing a tip end portion of a valve casing of FIG. 1.

Valve seat member 8 is inserted into small cylinder portion 2B of valve casing 2. Valve seat member 8 is made of a metallic material or resin material and has the form of cylinder as shown in FIG. 2. Formed at an inner periphery of valve seat member 8 are a valve insert hole 8A, a valve seat 8B and an injection port 8C at an inner periphery of valve seat member 8. Valve insert hole 8A is opened toward a base end portion of valve seat member 8. Valve seat 8B of a conical shape is formed at a tip end portion of valve insert hole 8A. Injection port 8C of a circular shape is surrounded by valve seat 8B.

Valve element 9 is displaceably disposed in valve casing 2. As shown in FIGS. 1 and 2, valve element 9 comprises a valve shaft 10 which is produced by bending a metal plate into a cylindrical shape and extends along the axial direction, attracting portion 11 which is made of a magnetic material in the form of a cylinder and is fixed to the base end portion of valve shaft 10, and a spherical valve member 12 which is fixed to a tip end portion of valve shaft 10 and is fitted to and released from valve seat 8B of valve seat member 8. A plurality of chamfered portions 12A are configured at an outer periphery of valve member 12 so as to form a clearance relative to the inner periphery of valve seat member 8.

When valve element 9 is put in a closed state, valve member 12 is biased by a force of a valve spring 16 and is fitted on valve seat 8B of valve seat member 8. During this closed state, attracting portion 11 and fuel inlet pipe 3 are axially and oppositely disposed with a clearance therebetween. When electromagnetic coil 13 is energized, electromagnetic coil 12 generates a magnetic field, and attracting portion 11 of valve element 9 is attracted due to the magnetization of fuel inlet pipe 3. Therefore, valve element 9 is axially displaced against the biasing force of valve spring 16. Valve member 12 is released from valve seat 8B, and valve element 9 is put in an open state shown in FIG. 10.

Electromagnetic coil 13 is disposed around fuel inlet pipe 3 and functions as an actuator of valve element 9. As shown in FIG. 1, electromagnetic coil 13 is covered with a resin cover 14 fixed to valve casing 2 and fuel inlet pipe 3. When electric power is applied to electromagnetic coil 13 through a connector 15 provided in resin cover 14, electromagnetic coil generates the magnetic field and opens valve element 9.

Valve spring 16 put in a compressed (biased) state is disposed in fuel inlet pipe 3. Valve spring 16 is located between valve element 9 and a cylindrical member 17 fixedly to an inner periphery of fuel inlet pipe 3 so as to bias valve element 9 toward valve seat member 8 to put the fuel, corresponding to the valve closed direction. When valve element 9 is opened against the biasing force of valve spring 16, fuel in fuel passage 6 is injected through a nozzle plate 18 toward branched right and left directions.

Figure 4:
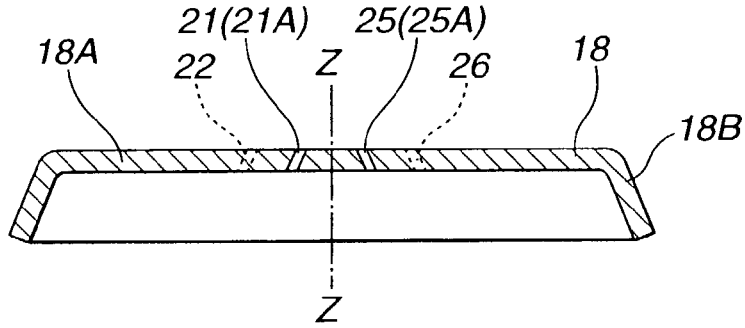
FIG. 4 is a cross sectional view taken in the direction of arrows IV—IV of FIG. 3.

Nozzle plate 18 is disposed at injection port 8C of valve seat member 8 so as to cover injection port 8C. Nozzle plate 18 comprises a flat plate portion 18A of a disc shape and a cylindrical portion 18B which is integral with and bent from an outer periphery of flat plate portion 18A, as shown in FIGS. 2 and 4. Nozzle plate 18 is made by presswork of a metal plate.

Figure 3:
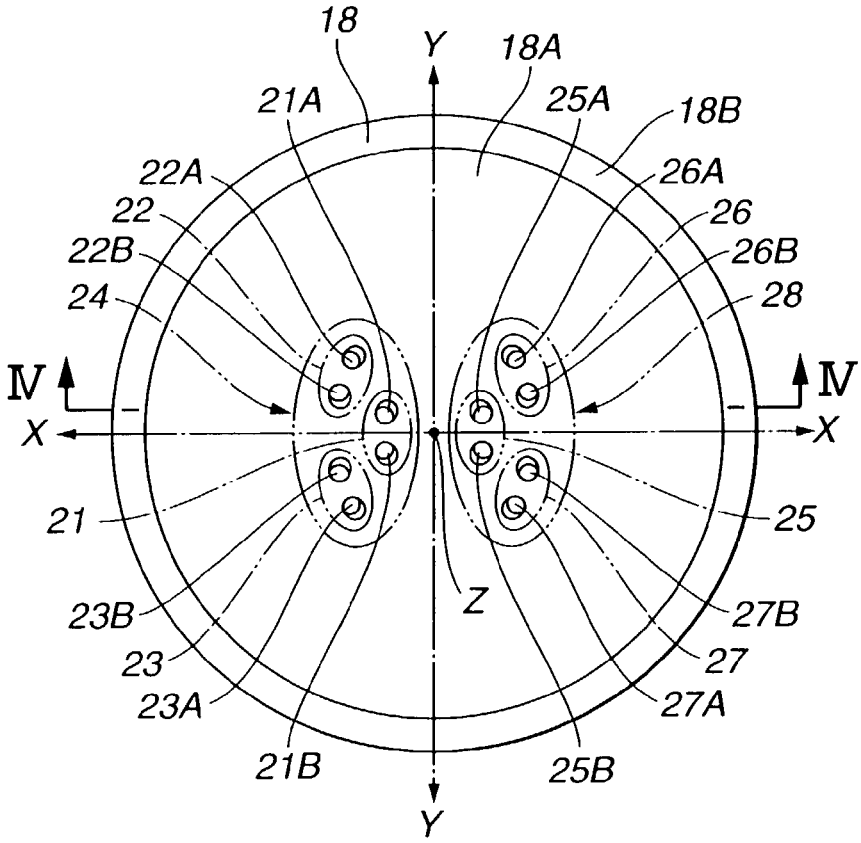
FIG. 3 is a plan view showing a nozzle plate of FIG. 1.

Flat plate portion 18A is fixed to a top end surface of valve seat member 8 by executing welding at welding portions 19. Nozzle-hole sets 21, 22, 23, 25, 26 and 27 are formed at a center area of flat plate portion 18A. As shown in FIG. 3, a first nozzle-hole-set aggregation 24 including nozzle-hole sets 21, 22 and 23 is disposed at a left center area, and a second nozzle-hole-set aggregation 28 including nozzle-hole sets 25, 26 and 27 is disposed at a right center area. First and second nozzle-hole-set aggregations 24 and 28 are arranged to inject fuel into different directions. Cylindrical portion 18B of nozzle plate 18 is welded with an inner surface of small cylinder portion 2*b* of valve casing 2 through welding portions 20.

Figure 5:
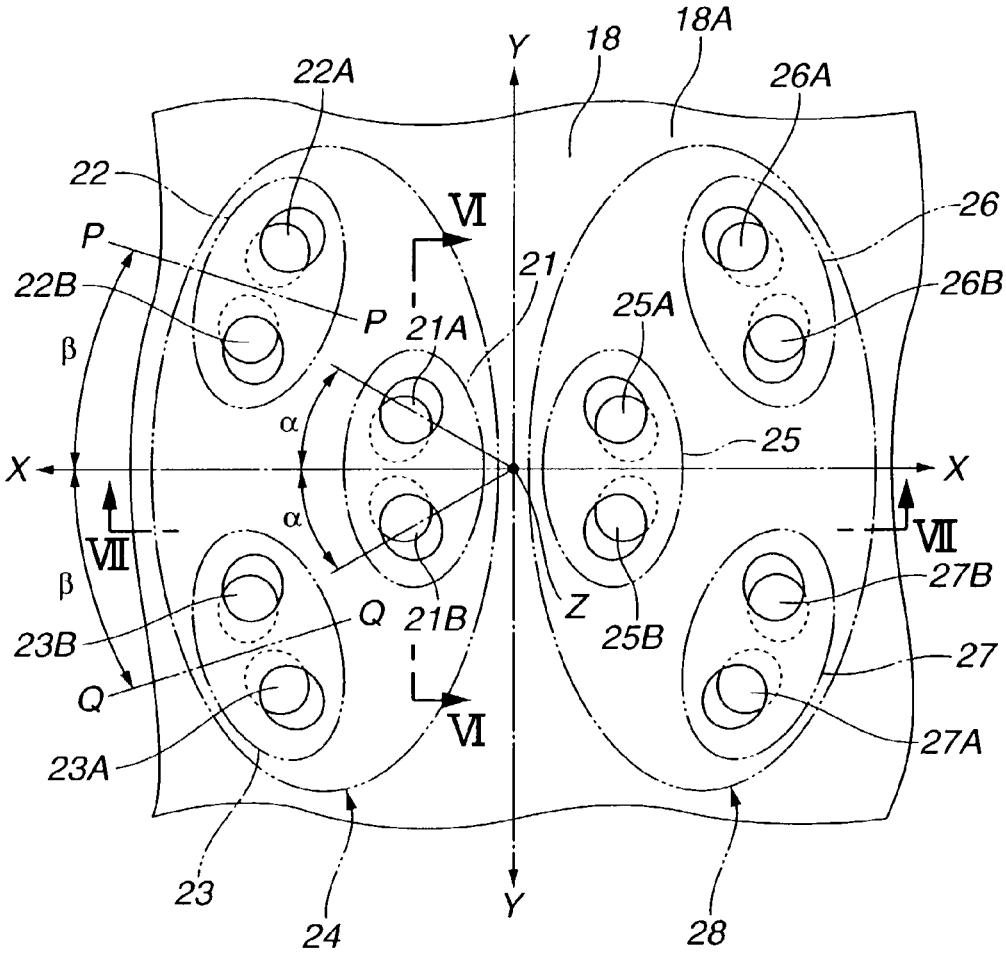
FIG. 5 is an enlarged plan view showing a center portion of the nozzle plate of FIG. 3.
Figure 6:
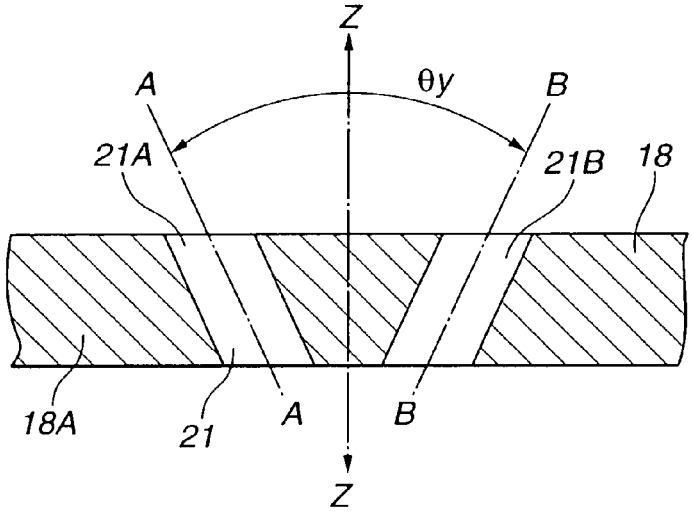
FIG. 6 is a cross sectional view taken in the direction of arrows VI—VI of FIG. 5.

Nozzle-hole set 21 comprises two nozzle holes 21A and 21B. Assuming that the X—X axis, the Y—Y axis and the Z—Z axis orthogonally intersect at the center of nozzle plate 18 as shown in FIG. 5, nozzle holes 21A and 21B are positioned at a left side of the Y—Y axis and are symmetric with respect to the X—X axis. As shown in FIG. 5, the X—X axis and the Y—Y axis extend along flat plate portion 18*a*, and the Z—Z axis is orthogonal t flat plate portion 18*a*. Nozzle holes 21A and 21B are positioned so that each line connecting a center of each nozzle hole 21A, 21B and the Z—Z axis intersects relative to the X—X axis at an angle a within a range from 2° to 45° as shown in FIG. 5. Further, when each of an A—A axis of nozzle hole 21A and a B—B axis of nozzle hole 21B are projected (focused) on a plane orthogonal to the X—X axis as shown in FIG. 6, the A—A axis and the B—B axis intersect at a tilt angle θy within a range from 10° to 80°, while sandwiching the X—X axis. That is, nozzle holes 21A and 21B are tilted with each other at the tilt angle θy.

Figure 7:
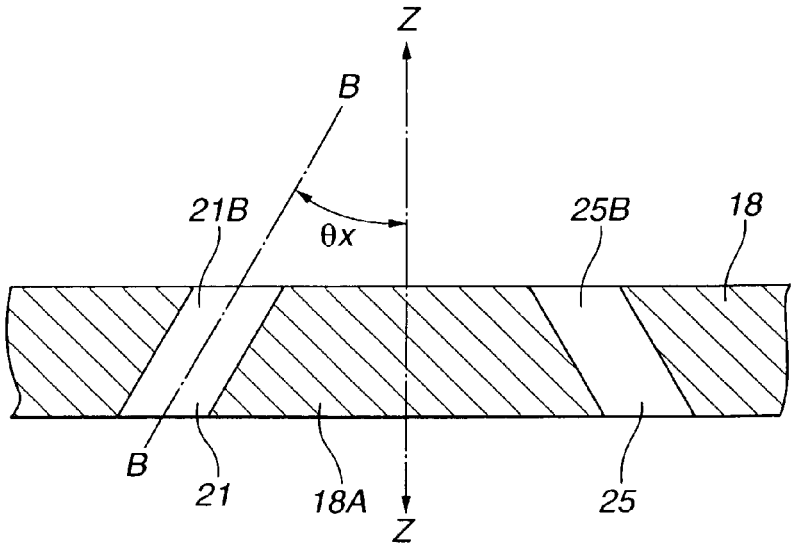
FIG. 7 is a cross sectional view taken in the direction of arrows VII—VII of FIG. 5.

Further, when the A—A axis and the B—B axis are projected on a plane orthogonal to the Y—Y axis as shown in FIG. 7, each of the A—A axis and the B—B axis is inclined relative to the Z—Z axis at a tilt angle θX within a range from 5° to 80° toward the left side of the X—X axis.

Figure 8:
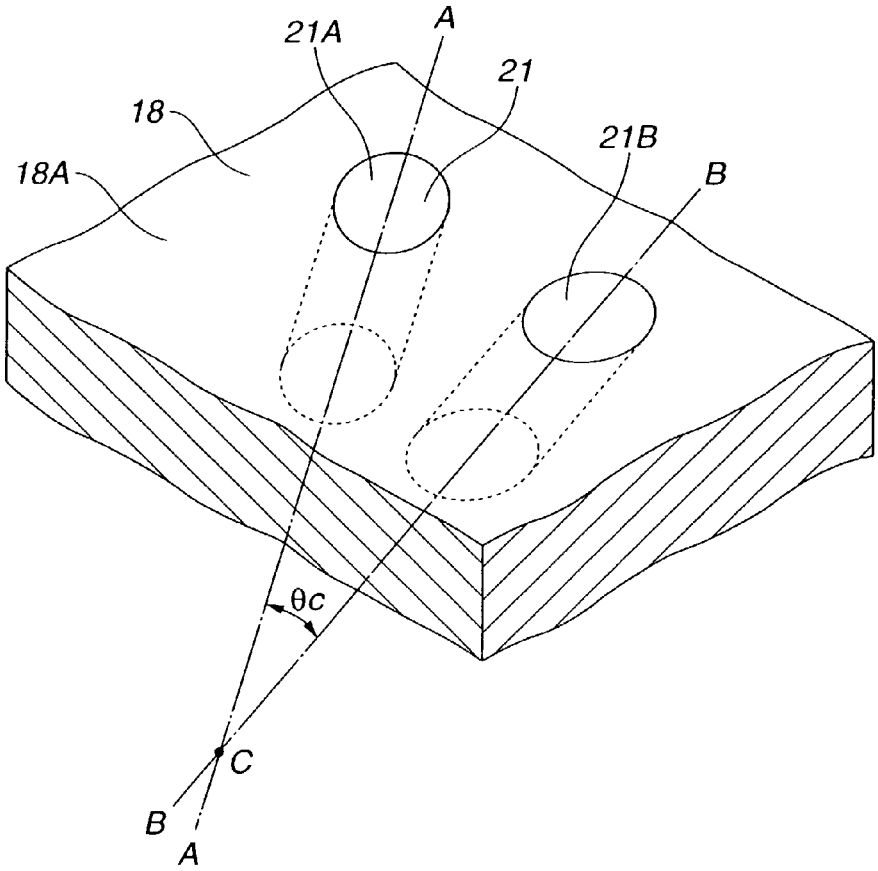
FIG. 8 is an enlarged perspective view showing two nozzle holes of a nozzle-hole set.

Furthermore, as shown in FIG. 8, the A—A axis of nozzle hole 21A and the B—B axis of nozzle hole 21B intersect at a point C located forward of nozzle plate to form an angle θc within a range from 30° to 170°. Accordingly, nozzle-hole set 21 injects fuel toward the left side direction in FIG. 2 while atomizing fuel by colliding two fuel injection flows injected from nozzle holes 21A and 21B.

Nozzle-hole set 22 is disposed above nozzle-hole set 21 in FIG. 5. Nozzle-hole set 22 comprises two nozzle holes 22A and 22B which are inclined toward the left side and are symmetric with respect to a line P—P in FIG. 5. Further, nozzle-hole set 22 are arranged such that fuel flows injected from nozzle holes 22A and 22B are collided with each other.

Nozzle-hole set 23 is disposed below nozzle-hole set 21 in FIG. 5. Nozzle-hole set 23 comprises two nozzle holes 23A and 23B which are inclined toward the left side and are symmetric with respect to a line Q—Q in FIG. 5. Further nozzle-hole set 23 is arranged such that fuel flows injected from nozzle holes 23A and 23B are collided with each other.

Nozzle-hole sets 22 and 23 are respectively arranged such that two nozzle holes generally similar to nozzle holes 21A and 21B of nozzle-hole set 21 are disposed at positions relative to a line P—P and a line Q—Q, respectively. Nozzle-hole sets 22 and 23 are symmetric with respect to the X—X axis. Each of the line P—P and the line Q—Q with respect to the X—X axis forms a tilt angle p within a range form 2° to 45°.

First nozzle-hole-set aggregation 24 is an aggregation of nozzle-hole sets 21, 22 and 23 and is disposed at the left hand side relative to the Y—Y axis of FIG. 5. First nozzle-hole-set aggregation 24 injects fuel toward the left hand side of FIG. 10 by joining the fuel injection flows atomized by colliding fuel injection flows by each of nozzle-hole sets 21, 22 and 23 so as to form a splay pattern 24*a* shown in FIG. 10.

On the other hand, first nozzle-hole-set aggregation 24 and second nozzle-hole-set aggregation 28 are symmetric with respect to the Y—Y axis. More specifically, nozzle-hole sets 25 and 21 are symmetric with respect to the Y—Y axis, nozzle-hole sets 26 and 22 are symmetric with respect to the Y—Y axis, and nozzle-hole sets 27 and 23 are symmetric with respect to the Y—Y. Nozzle-hole set 25 between nozzle-hole sets 26 and 27 comprises two nozzle holes 25A and 25B which are inclined toward the right hand side. Nozzle-hole set 26 located above nozzle-hole set 25 comprises nozzle holes 26A and 26B. Nozzle-hole set 27 located below nozzle-hole set 25 comprises nozzle holes 27A and 27B.

Second nozzle-hole-set aggregation 28 is an aggregation of nozzle-hole sets 25, 26 and 27, and is positioned at the right hand side relative to the Y—Y axis of FIG. 5. Second nozzle-hole-set aggregation 28 injects fuel toward the right hand side of FIG. 10 by joining the fuel injection flows atomized by colliding fuel injection flows by each of nozzle-hole sets 25, 26 and 27 so as to form a splay pattern 28*a* shown in FIG. 10.

The manner of operation of the fuel injection valve of the first embodiment will be discussed hereinafter.

When the electric power supplied through connector 15 energizes electromagnetic coil 13, the fuel injection valve is put in the operating (open) state. More specifically, attracting portion 11 of valve element 9 is magnetically attracted by electromagnetic coil 13 through valve casing 2, fuel inlet pipe 3 and magnetic path forming member 5, and therefore valve element 9 is opened against the biasing force of valve spring 16. With this opening of valve element 9, fuel in fuel passage 6 is injected to external of the fuel injection valve through nozzle holes 21, 22, 23, 25, 26 and 27 of nozzle plate 18.

Figure 9:
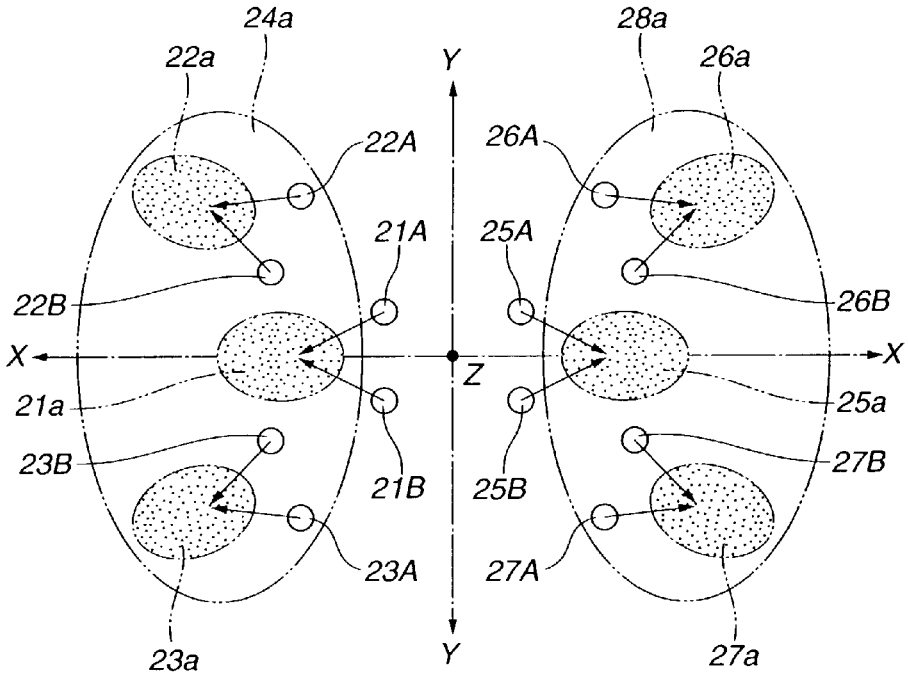
FIG. 9 is an explanatory view showing splay patterns of fuel injection flows injected from the fuel injection valve of FIG. 1.
Figure 10:
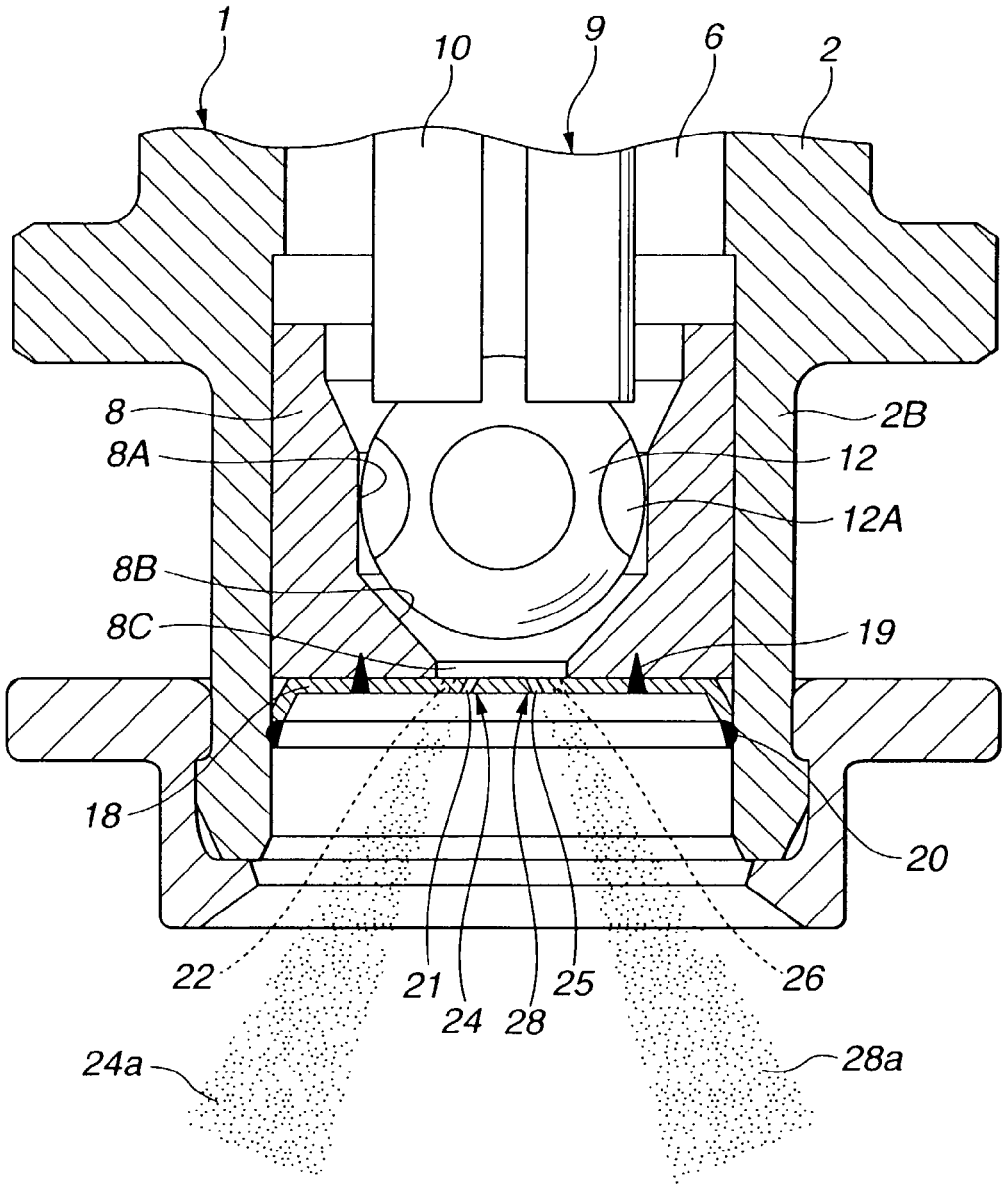
FIG. 10 is an enlarged cross sectional view showing the tip end portion of the valve casing of FIG. 1 under a condition that the fuel injection valve is in an operating condition.

At first nozzle-hole-set aggregation 24 located at the left hand side in FIG. 5, fuel injection flows injected from nozzle-hole set 21 collide with each other at a position between nozzle holes 21A and 21B to form a splay pattern 21*a* atomized by the collision, as shown in FIG. 9. Further, fuel injection flows injected from nozzle-hole set 22 collide with each other at a position between nozzle holes 22A and 22B to form a splay pattern 22*a* atomized by the collision, and fuel injection flows injected from nozzle-hole set 23 collide with each other at a position between nozzle holes 23A and 23B to form a splay pattern 23*a* atomized by the collision, as shown in FIG. 9. These splay patterns 21*a*, 22*a* and 23*a* are joined and form a large splay pattern 24*a*. As is clear from the large splay pattern 24*a*, the fuel injected from first nozzle-hole-set aggregation 24 is consequently injected toward the left hand side as shown in FIG. 10.

Similarly, at second nozzle-hole-set aggregation 28 located at the right hand side in FIG. 5, fuel injection flows injected from nozzle-hole set 25 collide with each other at a position between nozzle holes 25A and 25B to form a splay pattern 25*a* atomized by the collision, as shown in FIG. 9. Further, fuel injection flows injected from nozzle-hole set 26 collide with each other at a position between nozzle holes 26A and 26B to form a splay pattern 26*a* atomized by the collision, and fuel injection flows injected from nozzle-hole set 27 collide with each other at a position between nozzle holes 27A and 27B to form a splay pattern 27*a* atomized by the collision, as shown in FIG. 9. These splay patterns 25*a*, 26*a* and 27*a* are joined and form a large splay pattern 28*a*. As is clear from the large splay pattern 28*a*, the fuel injected from first nozzle-hole-set aggregation 28 is consequently injected toward the right hand side as shown in FIG. 10.

That is, the first embodiment of the fuel injection valve according to the present invention is arranged such that first nozzle-hole-set aggregation 24 is constituted by three nozzle-hole sets 21, 22 and 23 and that second nozzle-hole-set aggregation 28 is constituted by three nozzle-hole sets 25, 26 and 27. More specifically, first nozzle-hole-set aggregation 24 is arranged such that when fuel is injected from the fuel injection valve, the fuel injection flows injected from nozzle-hole sets 21, 22 and 23 are respectively collided at positions between nozzle holes 21A and 21B, between nozzle holes 22A and 22B, and between nozzle holes 23A and 23B so that the injected fuel is atomized by the collisions of the fuel injection flows. Further, the collided fuel injection flows are joined and injected toward the left hand side.

Similarly, second nozzle-hole-set aggregation 28 is arranged such that when fuel is injected from the fuel injection valve, the fuel injection flows injected from nozzle-hole sets 25, 26 and 27 are respectively collided at positions between nozzle holes 25A and 25B, between nozzle holes 26A and 26B, and between nozzle holes 27B and 27B so that the injected fuel is atomized by the collisions of the fuel injection flows. Further, the collided fuel injection flows are joined and injected toward the right hand side.

Therefore, this fuel injection valve according to the present invention enables fuel to be injected at proper positions such as toward right and left intake valves provided at inlets of each combustion chamber of an internal combustion engine while the fuel is properly atomized. This improves a combustion condition in the engine.

Further, with the arrangement of the first embodiment according to the present invention, it becomes possible to form the left side splay pattern 24*a* by means of nozzle-hole sets 21, 22 and 23 and to form the right side splay pattern 28*a* by mans of nozzle holes sets 25, 26 and 27. Accordingly, even if an internal combustion engine requires a fuel injection valve which is capable of injecting a relatively large quantity of fuel injection, the fuel injection valve according to the present invention can easily ensure such a large quantity of fuel injection by the whole of first and second nozzle-hole-set aggregations 24 and 28 without enlarging diameters of nozzle holes. That is, the fuel injection valve according to the present invention is capable of injecting a large quantity of fuel injection while promoting the atomization of fuel. Therefore, the fuel injection valve according to the present invention improves the performance and the degree of freedom in design.

Figure 11:
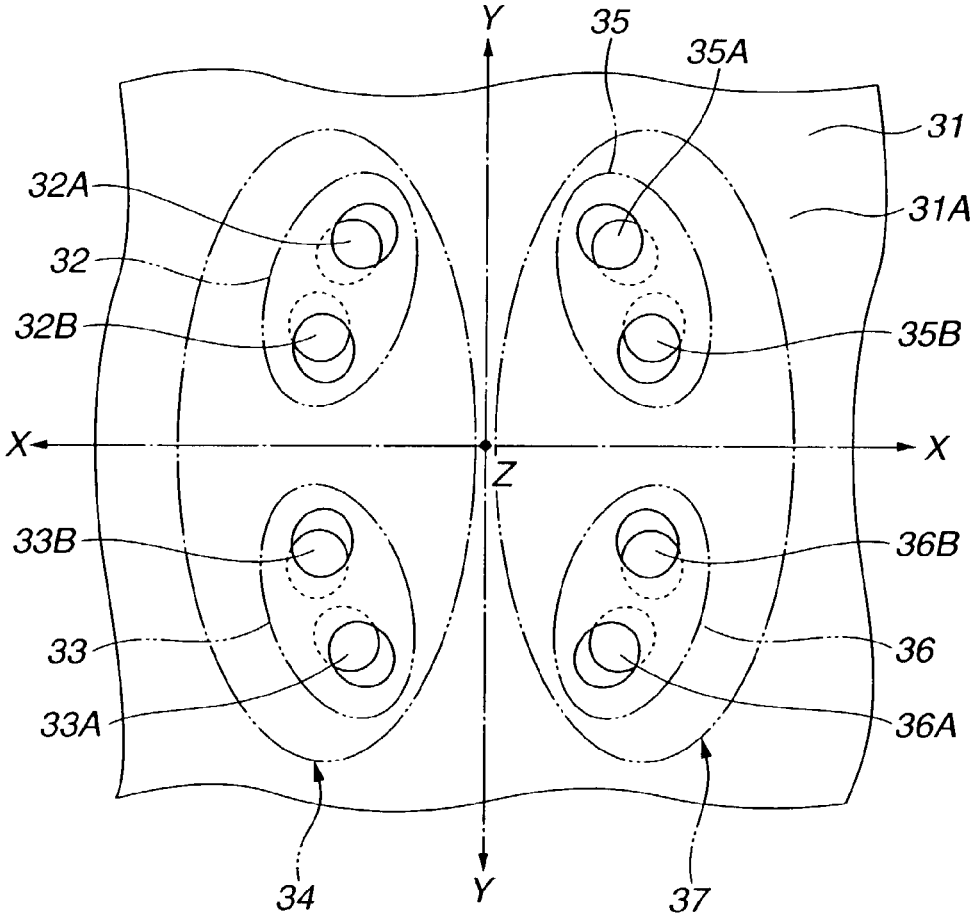
FIG. 11 is an enlarged plan view showing a nozzle plate of the fuel injection valve according to a second embodiment of the present invention.

Referring to FIG. 11, there is shown a second embodiment of the fuel injection valve according to the present invention. The second embodiment is specifically arranged such that each of first and second nozzle-hole-set aggregations 34 and 37 is constructed as an aggregation of two nozzle-hole sets. In this second embodiment, elements as same as those in the first embodiment are denoted by the same reference numerals, and the explanation thereof is omitted herein.

As is generally similar to the first embodiment, a nozzle plate 31 employed in the second embodiment is disposed at injection port 8C of valve seat member 8 so as to cover injection port 8C. Nozzle plate 31 comprises a flat plate portion 31A of a disc shape and a cylindrical portion 31B which is integral with and bent from an outer periphery of flat plate portion 31A. Nozzle-hole sets 32, 33, 35 and 36 are formed at a center area of flat plate portion 31A. As shown in FIG. 11, first nozzle-hole-set aggregation 34 including nozzle-hole sets 32 and 33 is disposed at a left center area, and second nozzle-hole-set aggregation 37 including nozzle-hole sets 35 and 36 is disposed at a right center area. First and second nozzle-hole-set aggregations 34 and 37 are arranged to inject fuel into different directions, respectively.

Nozzle-hole sets 32 and 33 are positioned at a left hand side of the Y—Y axis and are symmetric with respect to the X—X axis, as shown in FIG. 11. Further, nozzle-hole sets 32 and 33 are tilted toward the left hand side. Nozzle-hole set 32 comprises two nozzle holes 32A and 32B which are arranged to collide fuel injection flows injected from nozzle holes 32A and 32B with each other. Similarly, nozzle-hole set 33 comprises two nozzle holes 33A and 33B which are arranged to collide fuel injection flows injected from nozzle holes 33A and 33B with each other.

First nozzle-hole-set aggregation 34 is an aggregation of nozzle-hole sets 32 and 33 and is arranged to inject fuel toward the left hand side by joining fuel injection flows which are atomized by colliding fuel injection flows of each nozzle-hole set 32, 33.

Nozzle-hole sets 35 and 36 are positioned at a right hand side of the Y—Y axis and are symmetric with respect to the X—X axis, as shown in FIG. 11. Further, nozzle-hole sets 35 and 35 are tilted toward the right hand side. Nozzle-hole set 35 comprises two nozzle holes 35A and 35B which are arranged to collide fuel injection flows injected from nozzle holes 35A and 35B. Similarly, nozzle-hole set 36 comprises two nozzle holes 36A and 36B which are arranged to collide fuel injection flows injected from nozzle holes 36A and 36B with each other.

Second nozzle-hole-set aggregation 37 is an aggregation of nozzle-hole sets 35 and 36 and is arranged to inject fuel toward the right hand side by joining fuel injection flows which are atomized by colliding fuel injection flows of each nozzle-hole set 35, 36.

With the thus arranged second embodiment according to the present invention, it is possible to ensure advantages gained by the first embodiment.

Figure 12:
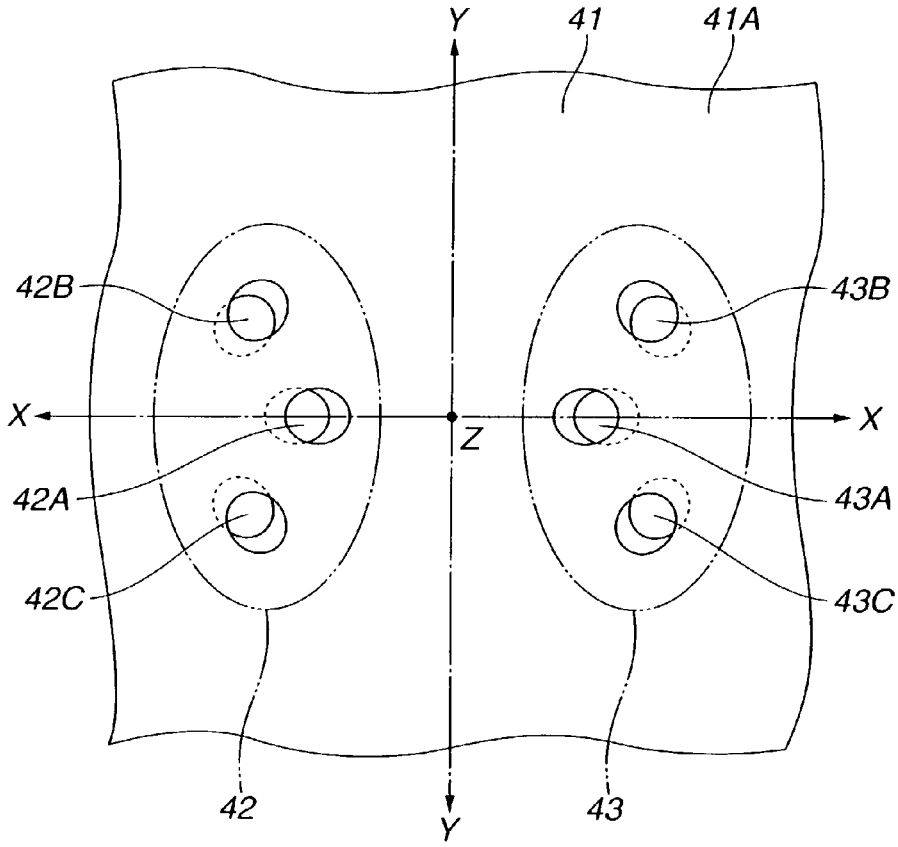
FIG. 12 is an enlarged plan view showing a nozzle plate of the fuel injection valve according to a third embodiment of the present invention an FIG. 13 is an explanatory view showing splay patterns of fuel injection flows injected from the fuel injection valve of FIG. 12.
Figure 13:
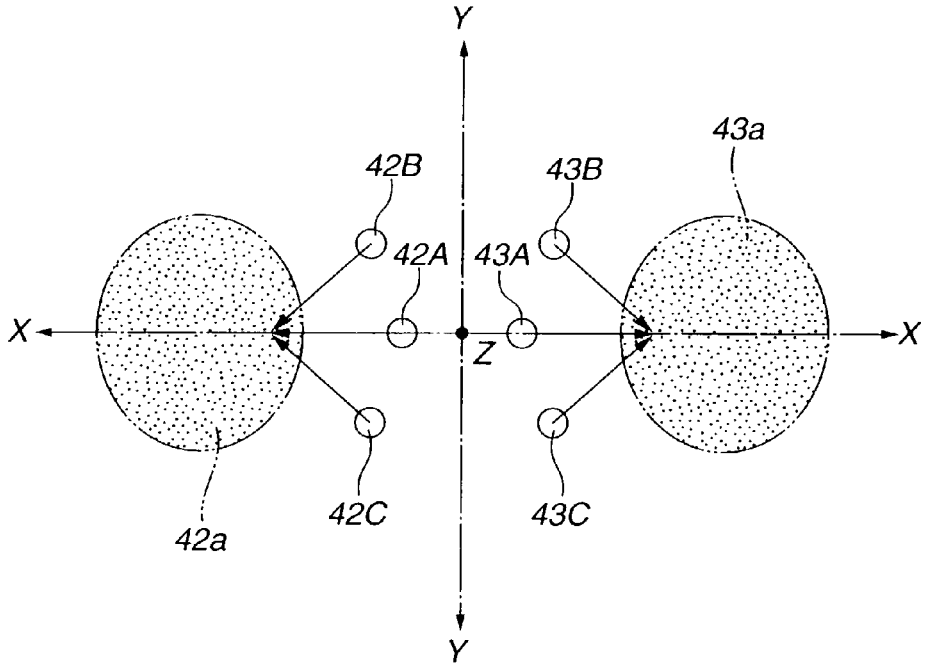

Referring to FIGS. 12 and 13, there is shown a third embodiment of the fuel injection valve according to the present invention. The third embodiment is specifically arranged such that each of first and second nozzle-hole sets 42 and 43 comprises three nozzle holes. In this third embodiment, elements as same as those in the first embodiment are denoted by the same reference numerals, and the explanation thereof is omitted herein.

As is generally similar to nozzle plate 18 of the first embodiment, a nozzle plate 41 of the third embodiment is disposed at injection port 8C of valve seat member 8 so as to cover injection port 8C. Nozzle plate 41 comprises a flat plate portion 41A of a disc shape and a cylindrical portion 41B which is integral with and bent from an outer periphery of flat plate portion 41A. Nozzle-hole sets 42 and 43 are formed at a center area of flat plate portion 41A.

As shown in FIG. 12, nozzle-hole set 42 including three nozzle holes 42A, 42B and 42C is disposed at a left center area. Nozzle holes 42A, 42B and 42C are arranged such that three axes of nozzle holes 42A, 42B and 42C tilt toward the left hand side and intersect at a point. Accordingly, fuel injected from nozzle-hole set 42 is atomized by colliding fuel injection flows injected from nozzle holes 42A, 42B and 42C, and the fuel injection flows are joined and injected toward the left hand side in the form of a splay pattern 42*a* as shown in FIG. 13.

Nozzle-hole set 43 including three nozzle holes 43A, 43B and 43C is disposed at a right center area and is symmetric to nozzle-hole set 43 with respect to the Y—Y axis. Therefore, nozzle holes 43A, 43B and 43C are also arranged such that three axes of nozzle holes 43A, 43B and 43C tilt toward the right hand side and intersect at a point. Accordingly, fuel injected from nozzle-hole set 43 is atomized by colliding fuel injection flows injected from nozzle holes 43A, 43B and 43C, and the fuel injection flows are joined and injected toward the right hand side in the form of a splay pattern 43*a* as shown in FIG. 13.

With the thus arranged third embodiment according to the present invention, it is possible to ensure advantages gained by the first embodiment.

Further, the fuel injection valve of the third embodiment according to the present invention is capable of colliding fuel injection flows injected from three injection holes 42A, 42B and 42C at a point, and of colliding fuel injection flows injected from three injection holes 43A, 43B and 43C at a point. Therefore, it is possible to promote the atomization of injected fuel while ensuring a relatively large quantity of fuel injection.

Although the first and second embodiment according to the present invention have been shown and described such that first and second nozzle-hole-set aggregations 24 and 28, 34 and 37 are constructed by three or two sets of nozzle-hole sets 21, 22, 23, 25, 26 and 27, or 32, 33, 35 and 36, it will be understood that the invention is not limited to these arrangements and may be arranged such that each nozzle-hole-set aggregation is constructed by four or more sets of nozzle-hole sets.

This application is based on Japanese Patent Applications No. 2001-214103 filed on Jul. 13, 2001 in Japan. The entire contents of this Japanese Patent Application are incorporated herein by reference.

Although the invention has been described above by reference to certain embodiments of the invention, the invention is not limited to the embodiments described above. Modifications and variations of the embodiments described above will occur to those skilled in the art, in light of the above teaching. The scope of the invention is defined with reference to the following claims.

What is claimed is:

1. A fuel injection valve, comprising:

a casing comprising a fuel passage;

a valve seat member disposed in the casing, the valve seat member comprising a valve seat;

a valve element displaceably disposed in the casing; and a nozzle plate covering the valve seat, the nozzle plate having a flat plate portion of a disc shape with parallel opposing surfaces and comprising at least four nozzle-hole sets each of which comprises at least two nozzle holes, fuel injection flows being injected from the nozzle holes, the flows from the at least two nozzle holes of each nozzle hole set being collided with each other when the valve element is released from the valve seat, the nozzle-hole sets constituting two nozzle-hole-set aggregations, the nozzle-hole-set aggregations being arranged to direct the collided fuel injection flows to two different directions.

2. The fuel injection valve as claimed in claim 1, wherein the nozzle-hole-set aggregations are symmetric with respect to a line crossing a center of the nozzle plate.

3. The fuel injection valve as claimed in claim 1, wherein the nozzle-hole-set aggregations are symmetric with respect to Y—Y axis when it is assumed that X—X axis Y—Y axis and Z—Z axis orthogonally intersect at a center of the nozzle plate and that the X—X axis and the Y—Y axis extend along the nozzle plate and the Z—Z axis is orthogonal to the nozzle plate.

4. The fuel injection valve as claimed in claim 3, wherein each of the nozzle-hole-set aggregations comprises first, second and third nozzle-hole sets, each of the first, second and third nozzle-hole sets comprising two nozzle holes, the nozzle holes of the first nozzle-hole set being positioned so that each line, which connects a center of each nozzle hole of the first nozzle-hole set and the Z—Z axis, intersects at an angle within a range from 2° to 45°.

5. The fuel injection valve as claimed in claim 4, wherein when axes of the two nozzle hole of the first nozzle-hole set are projected on a plane orthogonal to the X—X axis, the axes intersects at a tilt angle within a range from 10° to 80°.

6. The fuel injection valve as claimed in claim 4, wherein when the axes of the two nozzle hole of the first nozzle-hole set are projected on a plane orthogonal to the Y—Y axis, each of the axes is inclined relative to the Z—Z axis at a tilt angle within a range from 5° to 80° toward the direction apart from the Z—Z axis.

7. The fuel injection valve as claimed in claim 4, wherein axes of both nozzle holes of the first nozzle-hole set intersect at a point located forward of the nozzle plate to form an angle within a range from 30° to 170°.

8. The fuel injection valve as claimed in claim 4, wherein the second and third nozzle-hole sets are disposed to be symmetric with respect to the X—X axis, each of the second and third nozzle-hole sets comprising two nozzle holes which are inclined toward the direction apart from the Z—Z axis.

9. A fuel injection valve, comprising:

a casing defining a fuel passage;

a valve seat member disposed in the casing, the valve seat member defining a valve seat;

a valve element displaceably disposed in the casing; and a nozzle plate covering the valve seat, the nozzle plate having a flat plate portion of a disc shape with parallel opposing surfaces and comprising first and second nozzle-hole-set aggregations which are symmetrically arranged with respect to a center line of the nozzle plate, each of the first and second nozzle-hole-set aggregations comprising at least two nozzle-hole sets, each of the nozzle-hole sets comprising at least two nozzle holes, fuel injection flows being injected from the nozzle holes of each of the nozzle-hole sets, the flows from the at least two nozzle holes of each nozzle hole set being collided with each other when the valve element is displaced so as to form a clearance between the valve element and the valve seat, the fuel injection flows being joined by each of the first and second nozzle-hole-set aggregations and forming a splay pattern directed to a direction which gradually increasing a distance to an axis orthogonal to the center line and a plane including the nozzle holes of the nozzle plate.

* * * * *